US011277897B2

(12) United States Patent
Wang et al.

(10) Patent No.: US 11,277,897 B2
(45) Date of Patent: Mar. 15, 2022

(54) POINT-CONTROLLED LED LIGHT STRING AND MANUFACTURING METHOD THEREOF

(71) Applicants: An Wang, Zhejiang (CN); Rongji Mo, Zhejiang (CN); Xiaoyong Chen, Zhejiang (CN)

(72) Inventors: An Wang, Zhejiang (CN); Rongji Mo, Zhejiang (CN); Xiaoyong Chen, Zhejiang (CN)

(73) Assignee: Taizhou Jiaojiang Yingxing Electronic Co., Ltd., Taizhou (CN)

( * ) Notice: Subject to any disclaimer, the term of this patent is extended or adjusted under 35 U.S.C. 154(b) by 0 days.

(21) Appl. No.: 17/078,093

(22) Filed: Oct. 23, 2020

(65) Prior Publication Data

US 2021/0227667 A1 Jul. 22, 2021

(30) Foreign Application Priority Data

Jan. 18, 2020 (CN) ..... 202010056340.1

(51) Int. Cl.

| | |
|---|---|
| ***H05B 45/46*** | (2020.01) |
| ***H05B 45/48*** | (2020.01) |
| *F21Y 115/10* | (2016.01) |
| *F21K 9/90* | (2016.01) |
| *F21S 4/00* | (2016.01) |
| *F21V 23/00* | (2015.01) |

(52) U.S. Cl.

CPC ..... *H05B 45/48* (2020.01); *H05B 45/46* (2020.01); *F21K 9/90* (2013.01); *F21S 4/00* (2013.01); *F21V 23/005* (2013.01); *F21Y 2115/10* (2016.08)

(58) Field of Classification Search

CPC ..... H05B 45/44; H05B 45/00; H05B 45/46; H05B 45/48; F21S 4/00; F21K 9/90; F21Y 2115/10; F21V 23/005

See application file for complete search history.

(56) References Cited

U.S. PATENT DOCUMENTS

2012/0098445 A1* 4/2012 Park ..... H05B 47/19 315/193
2017/0094745 A1* 3/2017 Lai ..... H05B 47/185

FOREIGN PATENT DOCUMENTS

CN 201428980 Y 3/2010
CN 109027736 A 12/2018

* cited by examiner

*Primary Examiner* — Jimmy T Vu
(74) *Attorney, Agent, or Firm* — Minder Law Group; Willy H. Wong

(57) ABSTRACT

A point-controlled LED light string and a manufacturing method thereof, the light string comprises a DC power supply controller integrated with a plurality of address registers; and LED lights each with a unique address code. The LED lights form a light string with an address code random method, according to a sequence in which the LED lights are connected and arranged in the light string, associating the LED lights one to one with the corresponding address registers, and each of the address registers stores a corresponding address code of a corresponding LED light. The method comprises the steps of selecting LED lights each with a unique address code by an address code random method randomly to form a light string, storing the address codes of the LED lights in address registers arranged in an orderly manner, and associating the address registers one to one with corresponding LED lights.

13 Claims, 3 Drawing Sheets

POINT-CONTROLLED LED LIGHT STRING AND MANUFACTURING METHOD THEREOF

RELATED APPLICATIONS

This application claims priority to Chinese Patent Application No. CN202010056340.1, filed Jan. 18, 2020.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The invention belongs to the field of optoelectronic technology, and relates to a point-controlled LED light string and a manufacturing method thereof, more particularly to a point-controlled LED light string capable of controlling a single LED in the light string and a manufacturing method thereof.

Related Art

A point-controlled LED light string is generally composed of a power supply controller and a light string connected to the power supply controller. A control program can be stored in the power supply controller to control on and off of each LED light in the point-controlled LED light string, so that the whole point-controlled LED light string can show different patterns, such as flowing water patterns, flashing patterns, etc., especially RGB tri-color LED lights, which can also show different colors after being point-controlled for applications in dynamic pattern decoration of Christmas tree, and in dynamic patterns installed outside of buildings, etc., and have prospects for wide spectrum of application.

A very small control chip is integrated in each of the LED lights of the existing point-control LED light string, the control chip stores an unique address code, and the power supply controller controls on and off and colors of the LED lights through looking up addresses. Therefore, when the LED lights are composed into the point-controlled LED light string, it is necessary to assemble the LED lights according to the order of the unique address codes. This will greatly affect the production efficiency when there are hundreds or thousands of the LED lights. It is often difficult to find which LED light is assembled in the wrong order during quality inspection of the finished product.

Therefore, Chinese invention patent number 201810610816.4 discloses a relatively simple production method, for example, a two-level address lookup method of a program-controlled LED light string with power line transmission signals. After a first-level address lookup is completed, the following steps are performed sequentially: 1) executing a second-level rewriting program, and rewriting shared and fixed second-level address codes corresponding to sequential positions of LED lights of a same model light string; and 2) a second-level address lookup, recognizing only the secondary re-written fixed second-level address codes as objects for identification by control signals, sending the control signals to the fixed second-level addresses, and the main controller is restricted to be only used for specific light strings.

This method still follows the orderly coding sequences of the LED lights, and rewrites the second-level address codes into the LED lights in an orderly manner to replace the original first-level address codes. Although this method has higher production efficiency than assembling according to the coding sequences of the LED lights, the secondary coding of the LED lights affects the production efficiency.

SUMMARY OF THE INVENTION

In view of the above-mentioned problems in the prior art, the invention provides a point-controlled LED light string. The technical problem to be solved by the invention is how to improve the production efficiency of the point-controlled LED light string.

One object of one embodiment of the invention can be achieved by the following technical solutions: one embodiment of a point-controlled LED light string comprising a DC power supply controller, LED lights each with a unique address code, a power output interface of the DC power supply controller used to provide DC power and used to output a control signal, the control signal capable of controlling the LED lights to illuminate, wherein the LED lights are connected in series or in parallel to form a light string with an address code random method, the light string is connected to the power output interface, the DC power supply controller is integrated with a plurality of address registers, the address registers are arranged in an orderly manner, according to a connection sequence of the address registers, the address registers correspond one to one with the LED lights arranged in sequence on the light string, and each of the address registers stores a corresponding address code of a corresponding LED light.

A finished product of the point-controlled LED light string is formed by connecting the LED lights in series or in parallel by using the address code random method. In this way, when the light string is assembled, there is no need to consider the ordering of the LED lights, assembling can be done randomly and the specialized power supply controller is employed, and the power supply controller has the address registers with a quantity that is the same as or greater than a quantity of the LED lights. Generally, there will be hundreds or thousands of the address registers to adapt to light strings of different lengths. Collect a coded address of a first LED light, and store the coded address in a first register to correspond the register with the first LED light, and proceed one by one to correspond second and third LED lights with second and third registers respectively, that is, the LED lights are corresponding to the address registers one to one according to the order in which the LED lights are connected in the light string. When controlling the LED lights, simply call the coded addresses in the registers, and there is no need to consider the address codes of the LED lights. Therefore, the point-controlled LED light string is programmed for the registers, omitting the problem of sequencing of the LED lights. Compared with the prior art requiring sequencing of the address codes for the LED lights, the point-controlled LED light string of the invention is capable of improving the production efficiency.

In order to improve the production efficiency of one embodiment of the above-mentioned point-controlled LED light string, conventionally it is not easy to think of integrating the address registers in the light string and configuring the address registers orderly. The reason is that the configuration and installation processes will increase the production time, which is obviously contradicting to the consideration of improving the production efficiency. The solution provided by the invention not only integrates the address registers and arranges the address registers in an orderly manner, but also integrates the address registers in the DC power supply controller, and according to a connection sequence of the address registers, the address registers correspond one to one with the LED lights arranged in sequence on the light string. In a final step of checking whether the point-controlled LED light string can be used normally after the preliminary assembly is complete, if some of the LED lights are found to be damaged or defective and need to be replaced, the above-mentioned configuration makes it possible that only the address codes in the replaced LED lights need to be collected with a Bluetooth or WiFi module, and then store the address codes in the corresponding address registers to update data of the address codes. The operation does not need to change the programs programmed in the DC power supply controller, but only changes the data, which greatly shortens the time and greatly improves the efficiency. In the existing techniques, such as the main controller directly rewrites the codes, or configure the registers in the LED lights on the LED light string, then directly control the registers on the LED light string through the built-in programs of the main controller, if there is an installation error or some of the LED lights are defective and need to be replaced, all the programs in the main controller need to be re-burned with a burner again. Furthermore, controller chips of different manufacturers need to match the corresponding burners, which not only greatly increases the costs, but also the main controller chip needs to be connected to the hardware circuit for burning, which is not only complicated and troublesome, but also time-consuming. Therefore, taking into consideration final steps of production and installation, the solution provided by the invention improves an overall production efficiency of the electronically-controlled LED light string, and the structure is not a conventional configuration.

In one embodiment of the above-mentioned point-controlled LED light string, each of the LED lights comprises a control chip and a light-emitting diode connected to the control chip, and the control chip is disposed with a read-only memory for storing a 4-bit, 8-bit, or 16-bit address code. The address codes with different bits can be applied to different applications. A 8-bit address code can form a light string of 255 LED lights, and a 16-bit address code can be applied to a light string of thousands of LED lights.

In one embodiment of the above-mentioned point-controlled LED light string, each of the address registers is a 4-bit, 8-bit, or 16-bit non-volatile memory. The non-volatile memory can be a FALSH structure or an EEPROM structure. It is also more convenient to replace the LED lights or the address codes of the LED lights during maintenance.

In one embodiment of the above-mentioned point-controlled LED light string, the address code is stored in a corresponding address register in a stack mode, and addresses of the address registers are consecutively arranged. With the consecutive addresses, looking up the LED lights corresponding to the address registers is made easier.

In one embodiment of the above-mentioned point-controlled LED light string, the DC power supply controller is disposed with a bus, a microprocessor connected to the bus, and a power output interface connected to the bus, the address registers are connected to the bus of the power supply controller, the microprocessor controls the power output interface to continuously output high electric level as LED power, or output high and low electric level signals according to the corresponding address code stored in the address registers to control the corresponding LED light. In this way, point-controlling of the randomly arranged LED lights can be achieved.

One embodiment of the above-mentioned point-controlled LED light string is manufactured by the following method.

A manufacturing method for a point-controlled LED light string comprising the following steps of:

A. manufacturing a batch of LED lights each with a unique address code, randomly selecting the LED lights with an address code random method, and connecting the LED lights in series or in parallel to form a light string;

B. manufacturing a DC power supply controller with a plurality of address registers and the address registers being arranged in an orderly manner, and connecting the light string with a power output interface, the power output interface being used to provide DC power and used to output a control signal, the control signal capable of controlling the LED lights to illuminate; and C. collecting the address codes of the LED lights successively according to a sequence in which the LED lights being connected and arranged in the light string, storing the address codes of the LED lights in the address registers arranged in an orderly manner, and associating the address registers one to one with corresponding LED lights.

Step A adopts the address code random method to assemble the LED lights into the light string, which eliminates the need to consider the ordering of the LED lights, saves process steps and reduces work intensity, and can even use automated assembly machinery for connection of the light string with a long length, while the DC power supply controller in step B can be customized in advance to participate in automated assembly. In step C, the address codes of the LED lights are collected by a collection tool according to the order in which the LED lights are connected in the light string. Formed data can be stored in a storage device, or directly written into the sequentially configured address registers, and this method can also enable data transfer and backup for convenience of hardware maintenance. Pattern display of the LED light string can be programmed directly for the address registers in the DC power supply controller, without having to consider the structure of the LED light string hardware, making the product development environment friendly.

In one embodiment of the above-mentioned manufacturing method for the point-controlled LED light string, step A further comprises the steps of manufacturing a first control chip of a first LED light of the LED lights and writing a first address code into the first control chip, connecting the first control chip with a first light-emitting diode to form the first LED light, and then connecting the LED lights in series or in parallel on a power bus to form the light string.

As an alternative to step A, in one embodiment of the above-mentioned manufacturing method for the point-controlled LED light string, step A further comprises the steps of connecting a first control chip with a first light-emitting diode to form a first LED light of the LED lights, writing a first address code into the first control chip, and then connecting the LED lights in series or in parallel on a power bus to form the light string.

In one embodiment of the above-mentioned manufacturing method for the point-controlled LED light string, further comprising the steps of using an address code collecting tool to collect a first address code of a first LED light and then collecting remaining address codes of remaining LED lights according to a sequence in which the remaining LED lights being connected and arranged in the light string into a storage device, and writing the address codes in the storage device into the address registers of the DC power supply controller in a stack mode.

Compared with the prior art, the advantages of one embodiment of the invention are as follows:

1. The point-controlled LED light string forms a light string from the LED lights connected in series or in parallel by using the address code random method. When the light string is assembled, there is no need to consider the ordering of the LED lights, assembling can be done randomly. With the DC power supply controller having the address registers corresponding one to one with the LED lights, when controlling the LED lights, simply call the coded addresses in the registers, there is no need to consider the address codes of the LED lights, omitting the problem of sequencing of the LED lights, and improving the assembly efficiency of the LED light string hardware, also improving the convenience of software programming because the factor of the address codes of the LED lights can be neglected.

2. Since it is not necessary to consider the ordering of the LED lights, the manufacturing method for the point-controlled LED light string is capable of saving process steps and reducing work intensity, and automated assembly machinery can even be used for connection of the light string with a long length, and data of the address codes of the LED lights are collected by a collection tool to be stored in a storage device, data transfer and backup can be achieved for convenience of hardware maintenance.

DETAILED DESCRIPTION OF THE INVENTION

The technical solutions of the invention are further described below with reference to the specific embodiments of the invention in conjunction with the accompanied drawings, but the invention is not limited to the embodiments.

Embodiment 1

Figure 1:
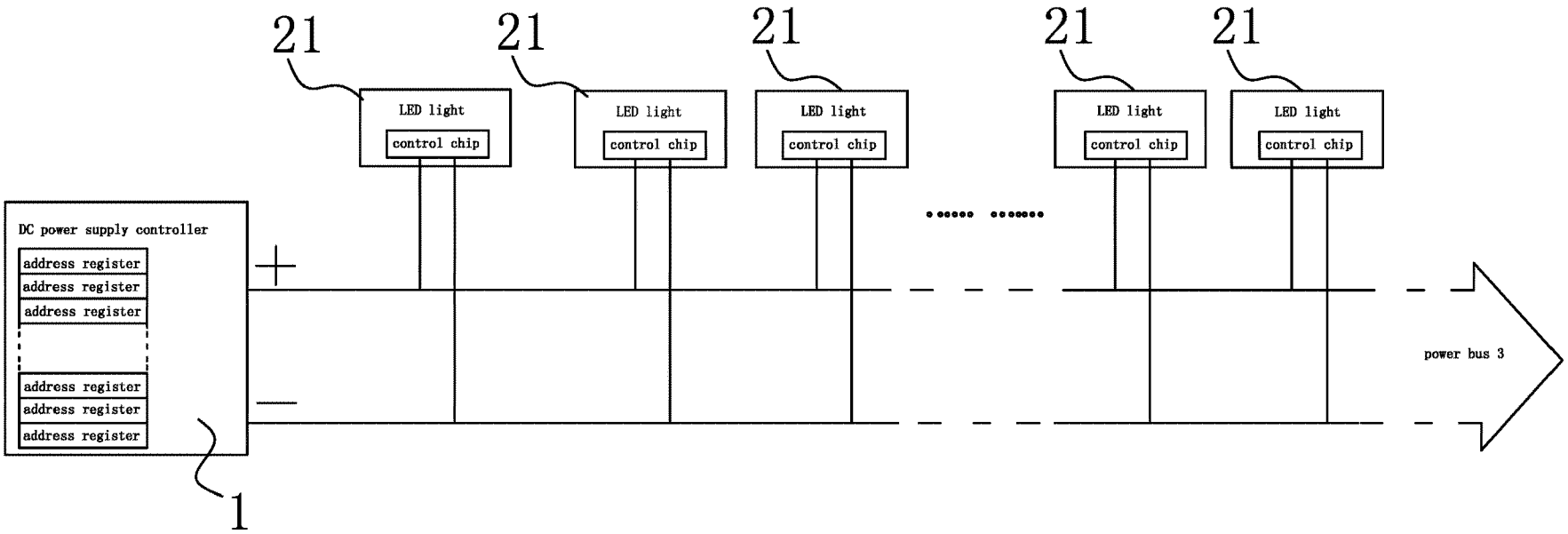
FIG. 1 is a schematic diagram of a structure of one embodiment of a point-controlled LED light string.

As shown in FIG. 1, one embodiment of a point-controlled LED light string comprises a DC power supply controller 1 and a light string 2, the light string 2 is formed by LED lights 21 each with a unique address code connected in parallel or in series by using an address code random method. In this embodiment, connection in parallel is adopted. A power output interface 11 of the DC power supply controller 1 is used to provide DC power and used to output a control signal, the control signal capable of controlling the LED lights 21 to illuminate. The light string 2 is connected to the power output interface 11, the DC power supply controller 1 is integrated with a plurality of address registers 12, and the address registers 12 are arranged in an orderly manner. According to a connection sequence of the address registers 12, the address registers 12 correspond one to one with the LED lights 21 arranged in sequence on the light string 2, and each of the address registers 12 stores a corresponding address code of a corresponding LED light 21. Through a finished product with the light string 2 formed by the LED lights 21 each with a unique address code arranged by using an address code random method, and the DC power supply controller 1 having the address registers 12 corresponding one to one with the LED lights 21, a manufacturing efficiency of the LED light string 2 can be improved. Specific description is provided below.

Figure 2:
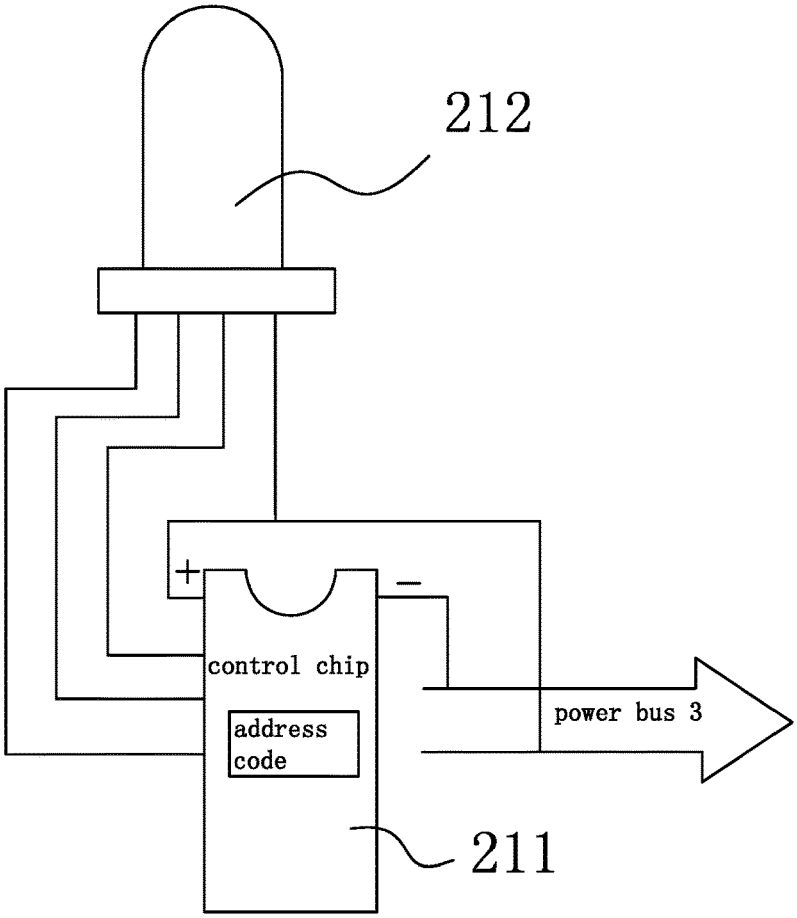
FIG. 2 is a schematic diagram of a structure of one embodiment of an LED light in FIG. 1.

With reference to FIG. 1 and FIG. 2, each of one embodiment of the LED lights 21 includes a control chip 211 and a light-emitting diode 212 connected to the control chip 211. The light-emitting diode 212 can be a monochromatic light-emitting diode 212 or a RGB tri-color light-emitting diode 212, the RGB tri-color light-emitting diode 212 is packaged with R light-emitting diode that emits red light, G light-emitting diode that emits green light, and B light-emitting diode that emits blue light. The control chip 211 is a microcontroller. The microcontroller is equipped with a ROM read-only memory for storing the address codes. The ROM read-only memory stores a unique 8-bit address code representing the LED light 21. Different address code sizes can be applied to different applications, the 8-bit address code can form the light string 2 with the 255 LED lights 21. As an option, the 16-bit address code can be applied to the light string 2 with thousands of the LED lights 21, and the 4-bit address code can be selected for smaller applications. The microcontroller is connected to a power bus 3, power is supplied for the microcontroller and the LED lights 21 through the power bus 3, and the control chip 211 and the DC power supply controller 1 perform serial communication through the power bus 3. When the DC power supply controller 1 looks up addresses, the time is very short, generally 10-50 milliseconds, and human eyes cannot feel flicker. Therefore, through the power bus 3, the DC power supply controller 1 is capable of supplying power to the LED lights 21, and individually controlling a certain LED light 21.

Figure 3:
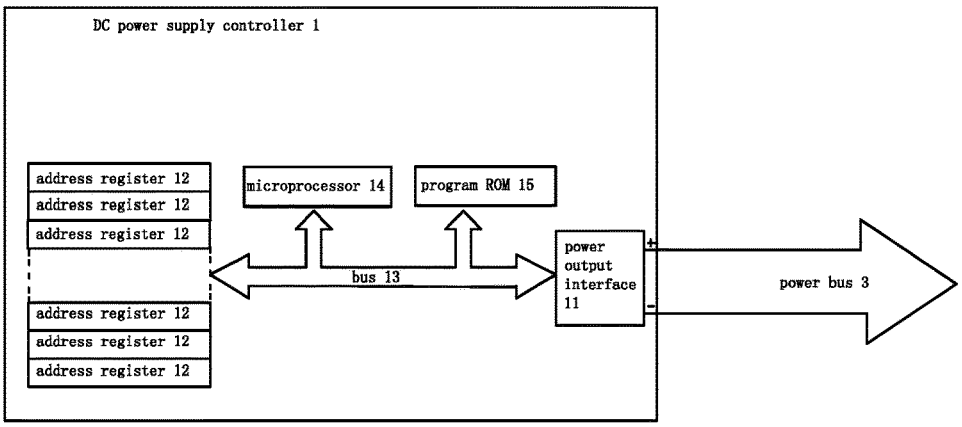
FIG. 3 is a schematic diagram of a structure of one embodiment of a DC power supply controller in FIG. 1.

With reference to FIG. 1 and FIG. 3, one embodiment of a bus 13 is configured in the DC power supply controller 1, and a microprocessor 14, a program ROM 15, a power output interface 11 and the address registers 12 are connected to the bus 13. The power output interface 11 is connected to the power bus 3, the address register 12 is a 8-bit non-volatile memory, the address code is stored in a corresponding address register 12 in a stack mode, and addresses of the address registers 12 are consecutively and sequentially arranged. Generally, the address registers 12 are arranged from low to high addresses, the first address register 12 corresponds to the first LED light 21, and the second address register 12 corresponds to the second LED light 21. Based on a program stored in a memory of the program ROM 15, the program being a control program for displaying various display patterns of the light string 2, the microprocessor 14 enables programming by a programmer directly according to the address registers 12 without considering the address codes of the LED lights 21 in the light string 2. When in operation, according to a preset program in the program ROM 15, the microprocessor 14 controls the power output interface 11 to continuously output high electric level as LED power, or output high and low electric level signals according to the corresponding address code stored in the address registers 12 to control the corresponding LED light 21.

Figure 4:
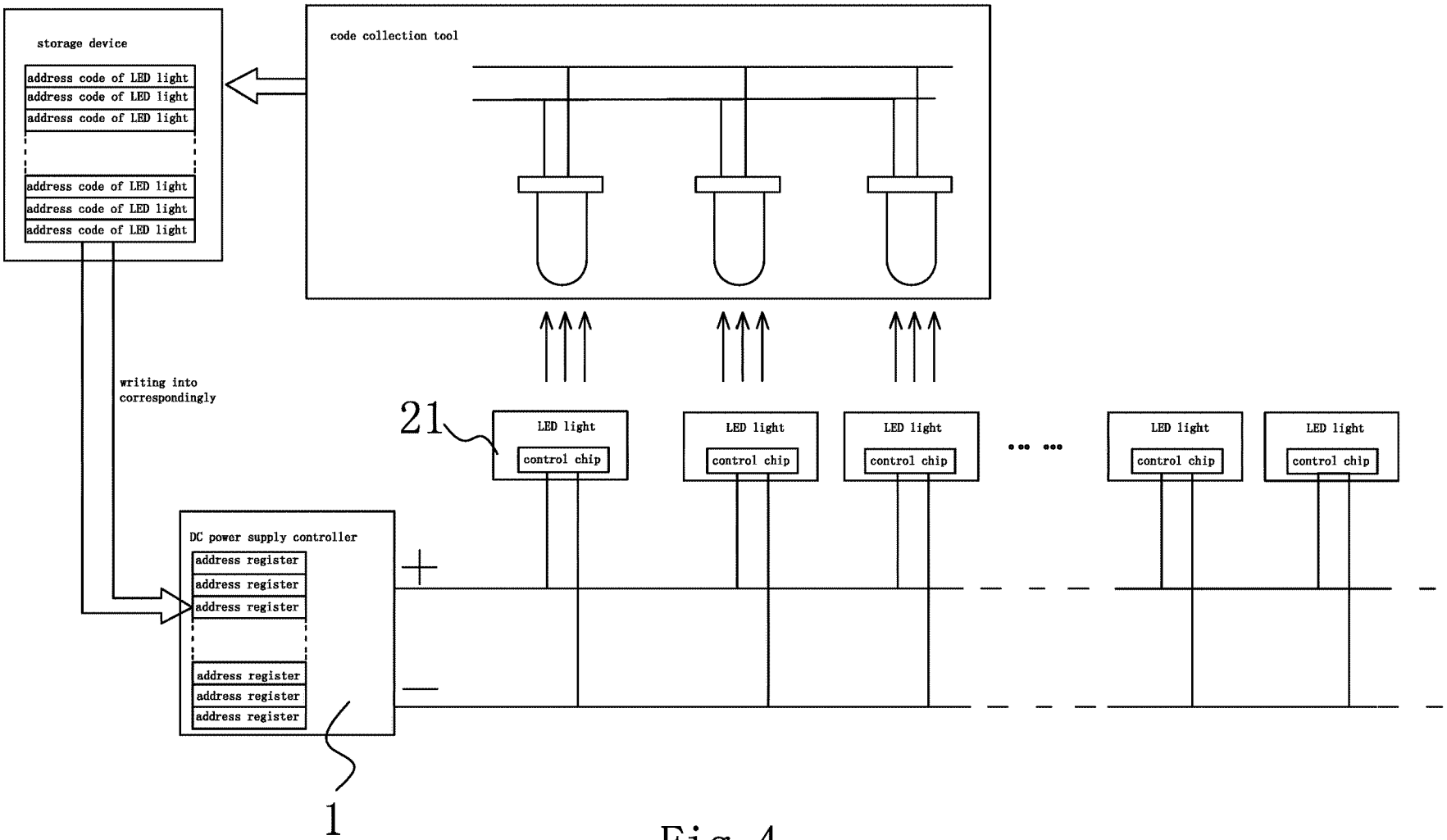
FIG. 4 is a schematic diagram of a process of step C in one embodiment of a manufacturing method for the point-controlled LED light string.

As shown in FIG. 4, one embodiment of the above-mentioned point-controlled LED light string 2 is obtained by a manufacturing method comprising the following steps of:

A. manufacturing a first control chip 211 of a first LED light 21 of LED lights 21 and writing a unique first address code into the first control chip 211, connecting the first control chip 211 with a first light-emitting diode 212 to form the first LED light 21 each with a unique address code, randomly selecting the LED lights 21 with an address code random method, and connecting the LED lights 21 in series or in parallel to form a light string 2;

B. manufacturing a DC power supply controller 1 with a plurality of address registers 12 and the address registers 12 being arranged in an orderly manner, and connecting the light string 2 with a power output interface 11, the power output interface 11 being used to provide DC power and used to output a control signal, the control signal capable of controlling the LED lights 21 to illuminate; and C. using a conventional address code collection tool to sequentially collect address codes of the LED lights 21 according to a sequence in which the LED lights 21 being connected and arranged in the light string 2, collecting a first address code of a first LED light 21 of the light string 2 and then collecting remaining address codes of remaining LED lights 21 of the light string 2 into a storage device such as mobile phone or computer, and writing the address codes in the storage device into the address registers 12 of the DC power supply controller 1 in a stack mode, storing the address codes of the LED lights 21 in the address registers arranged in an orderly manner, and associating the address registers 12 one to one with the corresponding LED lights 21. To speed up collection speed, multiple collection heads can be used to collect at the same time, such as a group of 8 collection heads for collection.

Embodiment 2

The content of the second embodiment is basically the same as that of the first embodiment. The difference lies in step A in the manufacturing method for the point-controlled LED light string 2. In this embodiment, connecting the first control chip 211 with the first light-emitting diode 212 to form the first LED light 21 of the LED lights 21, writing the unique first address code into the first control chip 211 of the first LED light 21, and then connecting the LED lights 21 in series or in parallel on the power bus 3 to form the light string 2.

The specific embodiments described herein are merely illustrative of the spirit of the present invention. Technicians skilled in the art to which the present invention pertains can make various modifications or additions to the specific embodiments described or replace them in a similar manner, without departing from the spirit of the present invention or beyond the scope defined by the appended claims.

LIST OF REFERENCED PARTS

1 DC power supply controller
11 power output interface
12 address register
13 bus
14 microprocessor
15 program ROM
2 light string
21 LED light
211 control chip
212 light-emitting diode
3 power bus

What is claimed is:

1. A point-controlled LED light string comprising:
a DC power supply controller;
LED lights each with a unique address code, the address codes arranged in an order; and
a power output interface of the DC power supply controller used to provide DC power and output a control signal capable of controlling the LED lights to illuminate;
wherein the LED lights are connected in series or in parallel to form a light string independent of the order of the address codes, the light string is connected to the power output interface, the DC power supply controller is integrated with a plurality of address registers, the address registers are arranged in an orderly manner, the LED lights correspond one to one with the address registers according to a sequence in which the LED lights are connected and arranged in the light string, and each of the address registers stores a corresponding address code of a corresponding LED light.

2. The point-controlled LED light string as claimed in claim 1, wherein each of the LED lights comprises a control chip and a light-emitting diode connected to the control chip, and the control chip is disposed with a read-only memory for storing a 4-bit or 8-bit or 16-bit address code.

3. The point-controlled LED light string as claimed in claim 2, wherein each of the address registers is a 4-bit or 8-bit or 16-bit non-volatile memory.

4. The point-controlled LED light string as claimed in claim 1, wherein the address code is stored in a corresponding address register in a stack mode, and addresses of the address registers are consecutively arranged.

5. The point-controlled LED light string as claimed in claim 2, wherein the address code is stored in a corresponding address register in a stack mode, and addresses of the address registers are consecutively arranged.

6. The point-controlled LED light string as claimed in claim 3, wherein the address code is stored in a corresponding address register in a stack mode, and addresses of the address registers are consecutively arranged.

7. The point-controlled LED light string as claimed in claim 2, wherein the DC power supply controller is disposed with a bus, a microprocessor connected to the bus, and a power output interface connected to the bus, the address registers are connected to the bus, the microprocessor controls the power output interface to continuously output high electric level to power the LED lights or to output high and low electric level signals according to the corresponding address code stored in the address registers to control the corresponding LED light.

8. A manufacturing method for a point-controlled LED light string comprising the following steps of:

A. manufacturing a batch of LED lights each with a unique address code, the address codes arranged in an order, selecting the LED lights independent of the order of the address codes, and connecting the LED lights in series or in parallel to form a light string;

B. manufacturing a DC power supply controller having a power output interface and a plurality of address registers arranged in an orderly manner, and connecting the light string with the power output interface, the power output interface being used to provide DC power and output a control signal, the control signal capable of controlling the LED lights to illuminate; and C. collecting the address codes of the LED lights successively according to a sequence in which the LED lights are connected and arranged in the light string, storing the address codes of the LED lights in the address registers, and associating the address registers one to one with corresponding LED lights.

9. The manufacturing method for the point-controlled LED light string as claimed in claim 8, wherein step A further comprises the steps of manufacturing a first control chip of a first LED light of the LED lights and writing a first address code into the first control chip, connecting the first control chip with a first light-emitting diode to form the first LED light, and then connecting the LED lights in series or in parallel on a power bus to form the light string.

10. The manufacturing method for the point-controlled LED light string as claimed in claim 8, wherein step A further comprises the steps of connecting a first control chip with a first light-emitting diode to form a first LED light of the LED lights, writing a first address code into the first control chip, and then connecting the LED lights in series or in parallel on a power bus to form the light string.

11. The manufacturing method for the point-controlled LED light string as claimed in claim 8 further comprising the steps of using an address code collecting tool to collect address codes of the LED lights starting from a first LED light and according to a connecting sequence of the LED lights in the light string, entering the address codes into a storage device, and writing the address codes from the storage device into the address registers of the DC power supply controller in a stack mode.

12. The manufacturing method for the point-controlled LED light string as claimed in claim 9 further comprising the steps of using an address code collecting tool to collect address codes of the LED lights starting from a first LED light and according to a connecting sequence of the LED lights in the light string, entering the address codes into a storage device, and writing the address codes from the storage device into the address registers of the DC power supply controller in a stack mode.

13. The manufacturing method for the point-controlled LED light string as claimed in claim 10 further comprising the steps of using an address code collecting tool to collect address codes of the LED lights starting from a first LED light and according to a connecting sequence of the LED lights in the light string, entering the address codes into a storage device, and writing the address codes from the storage device into the address registers of the DC power supply controller in a stack mode.

* * * * *